US011761415B2

(12) United States Patent
Yoshizaki et al.

(10) Patent No.: US 11,761,415 B2
(45) Date of Patent: Sep. 19, 2023

(54) IGNITION COIL UNIT

(71) Applicants: YAMABIKO CORPORATION, Tokyo (JP); Oppama Industry Co., Ltd., Kanagawa (JP)

(72) Inventors: Takuo Yoshizaki, Tokyo (JP); Atsushi Hoshino, Tokyo (JP); Yuichi Tsuyuki, Kanagawa (JP); Kousuke Watanabe, Kanagawa (JP)

(73) Assignees: OPPAMA INDUSTRY CO., LTD., Kanagawa (JP); YAMABIKO CORPORATION, Tokyo (JP)

( * ) Notice: Subject to any disclaimer, the term of this patent is extended or adjusted under 35 U.S.C. 154(b) by 0 days.

(21) Appl. No.: 17/501,179

(22) Filed: Oct. 14, 2021

(65) Prior Publication Data

US 2023/0003184 A1 Jan. 5, 2023

(30) Foreign Application Priority Data

Oct. 16, 2020 (JP) ..... 2020-174757

(51) Int. Cl.

| | |
|---|---|
| ***F02P 5/00*** | (2006.01) |
| ***F02P 5/15*** | (2006.01) |
| ***F02P 3/04*** | (2006.01) |
| ***H01F 38/12*** | (2006.01) |

(52) U.S. Cl.

CPC ..... *F02P 5/1502* (2013.01); *F02P 3/04* (2013.01); *H01F 38/12* (2013.01)

(58) Field of Classification Search

CPC ..... F02P 5/1502; F02P 3/04; H01F 38/12

See application file for complete search history.

(56) References Cited

U.S. PATENT DOCUMENTS

| | | | | |
|---|---|---|---|---|
| 7,000,595 | B2 * | 2/2006 | Andersson | F02P 5/1504 123/480 |
| 10,859,059 | B2 * | 12/2020 | Nakamura | F02P 15/10 |
| 11,300,092 | B2 * | 4/2022 | Osawa | F02P 3/055 |

(Continued)

FOREIGN PATENT DOCUMENTS

| | | | |
|---|---|---|---|
| DE | 202018105999 | U1 | 10/2018 |
| EP | 1277939 | A2 | 1/2003 |

(Continued)

OTHER PUBLICATIONS

EESR cited in corresponding International Appln. No. EP21202872.4 dated Mar. 10, 2022.

*Primary Examiner* — Phutthiwat Wongwian
*Assistant Examiner* — Sherman D Manley
(74) *Attorney, Agent, or Firm* — BACON & THOMAS, PLLC

(57) ABSTRACT

An ignition coil unit includes: an ignition circuit including a primary coil and a secondary coil; a power generator including a generator coil; a controller configured to control an ignition timing of the ignition circuit by an input signal generated by an induced voltage of the generator coil; and a sensor configured to input load information to the controller. The controller includes a memory configured to store working time information which corresponds to operating information based on the input information and the load information, as matrix data composed of the operating information, the load information and time data.

6 Claims, 4 Drawing Sheets

(56) References Cited

U.S. PATENT DOCUMENTS

| | | | | |
|---|---|---|---|---|
| 2004/0182366 | A1* | 9/2004 | Andersson | F02D 35/0061 123/406.47 |
| 2005/0027430 | A1* | 2/2005 | Amano | F02D 41/123 123/406.53 |
| 2010/0147544 | A1* | 6/2010 | Yoshizaki | F02D 11/04 173/176 |
| 2014/0184397 | A1 | 7/2014 | Volpert | |
| 2017/0184067 | A1* | 6/2017 | Ogura | F02P 3/06 |
| 2018/0013266 | A1* | 1/2018 | Iwamoto | H02H 5/044 |
| 2020/0126319 | A1* | 4/2020 | Russ | G06V 20/41 |
| 2021/0095631 | A1* | 4/2021 | Terada | F02P 17/12 |
| 2021/0108605 | A1* | 4/2021 | Yamagishi | F02P 3/05 |

FOREIGN PATENT DOCUMENTS

| | | | |
|---|---|---|---|
| EP | 1277939 | A3 | 5/2006 |
| EP | 3291181 | A1 | 3/2018 |
| JP | H08-170989 | A | 7/1996 |
| JP | 2008-75502 | A | 4/2008 |
| JP | 2014-173429 | A | 9/2014 |
| WO | WO2013-134709 | A1 | 9/2013 |
| WO | WO2013-134709 | A8 | 9/2013 |

* cited by examiner

IGNITION COIL UNIT

CROSS-REFERENCE TO RELATED APPLICATIONS

The present application claims priority from Japanese Patent Application No. 2020-174757 filed on Oct. 16, 2020, and the entire contents of which are hereby incorporated by reference.

BACKGROUND

1. Technical Field

The present invention relates to an ignition coil unit.

2. Related Art

A unitized ignition coil (hereinafter referred to as "ignition coil unit") is employed in an engine widely used as a power source for a handheld working machine such as a sprayer, a spreader, and a mower. For example, the ignition coil unit including: a generator coil configured to generate an induced voltage in synchronization with the rotation of the engine; an ignition circuit including a primary coil and a secondary coil; and an ignition control circuit configured to supply an ignition voltage to the primary coil at a predetermined ignition timing based on the voltage induced by the generator coil, which are unitized, for example, by resin-molding, has been disclosed in Japanese Unexamined Patent Application Publication No. 2008-75502.

In addition, for example, a time totaling meter configured to calculate a cumulative operating time of an engine and a working machine using an ignition pulse has been proposed in Japanese Unexamined Patent Application Publication No. H08-170989.

This time totaling meter can count, store, and display the cumulative time of the engine from the starting of operation, and a user can conduct maintenance and repair of the engine and the working machine based on data of the cumulative time.

The ignition coil unit can obtain the data of the cumulative time for maintenance of the engine and the working machine by installing the above-described time totaling meter. However, it is not possible to specifically know the operating states of the engine and the working machine only by cumulating the operating time, and therefore not possible to conduct a precise evaluation for the maintenance.

Moreover, the knowledge of the operating states of the individual engine and working machine when used allows understanding of the operating characteristics or habits of users. The operating characteristics of the users are different for each of the users, and there is demand to provide proper service to each of the users after understanding the operating characteristics of the individual users.

SUMMARY

The present invention is proposed to address the above-described problem. It is therefore an object of the present invention to provide an ignition coil unit capable of conducting precise maintenance of an engine and a working machine with a proper evaluation index, and providing proper service to each of the users after knowing the operating state of the individual engine or working machine and understanding the operating characteristic of the user.

An aspect of the present invention provides an ignition coil unit including: an ignition circuit including a primary coil and a secondary coil; a power generator including a generator coil; a controller configured to control an ignition timing of the ignition circuit by an input signal generated by an induced voltage of the generator coil; and a sensor configured to input load information to the controller, wherein the controller includes a memory configured to store working time information which corresponds to operating information based on the input information and the load information, as matrix data composed of the operating information, the load information and time data.

According to the present invention, it is possible to conduct precise maintenance of an engine and a working machine with an appropriate evaluation index, and provide proper service to each of the users after knowing the operating state of the individual engine or working machine and understanding the operating characteristic of the user.

DETAILED DESCRIPTION

Hereinafter, an embodiment of the present invention will be described with reference to the drawings. The same reference numbers in the different drawings indicate the same functional sections, and therefore repeated description for each of the drawings is omitted.

Figure 1:
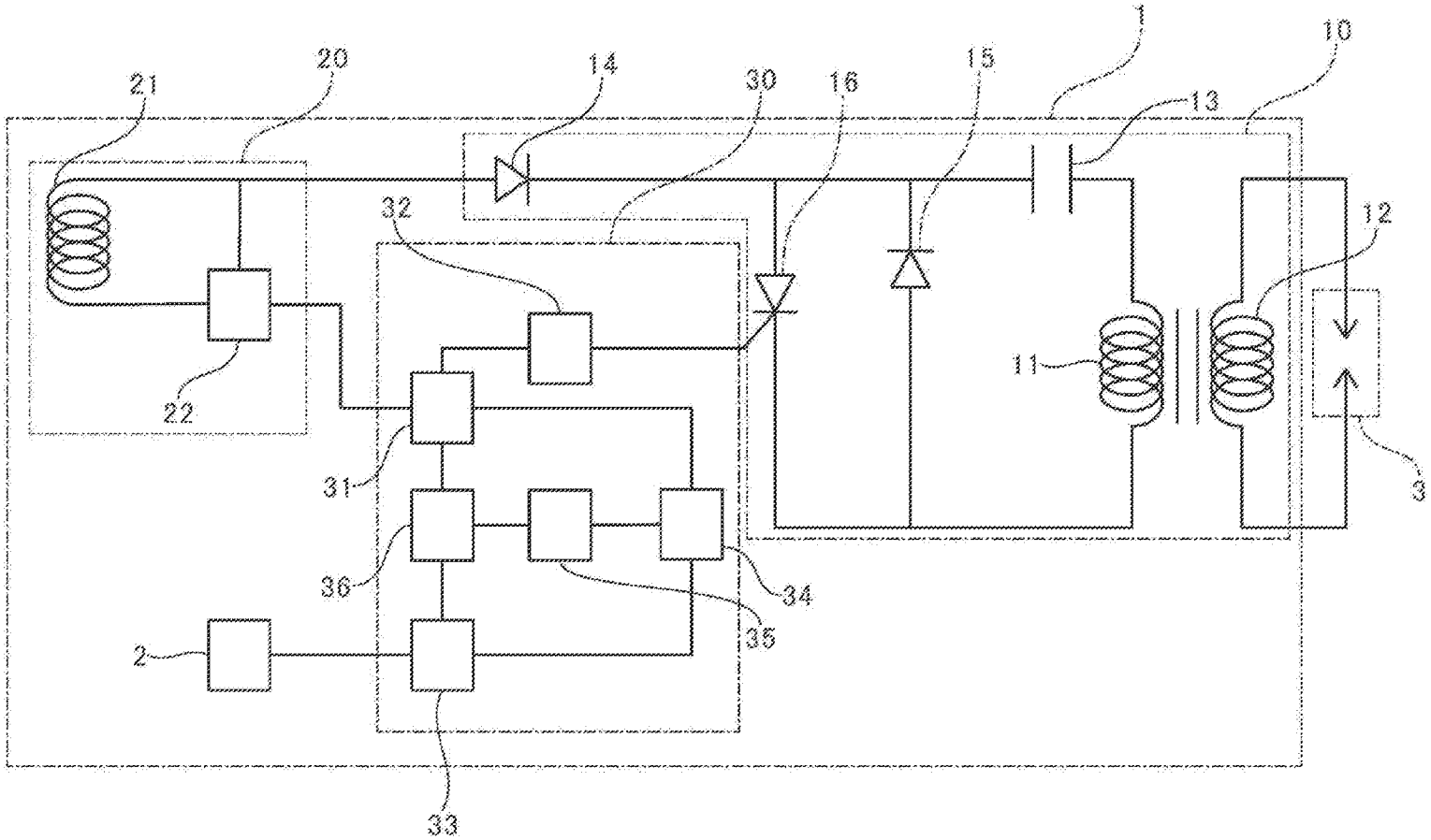
FIG. 1 illustrates a constitutional example of an ignition coil unit according to an embodiment of the present invention.

In FIG. 1, an ignition coil unit 1 includes an ignition circuit 10, a power generator 20, a controller 30 and a sensor 2, which are unitized.

The ignition circuit 10 includes a primary coil 11, a secondary coil 12, a capacitor 13, diodes 14 and 15, and a thyristor 16. The primary coil 11 is supplied with an ignition voltage of electricity stored in the capacitor 13, and a spark plug 3 is connected to the secondary coil 12. An induced voltage generated by the generator coil 21 of the power generator 20 is rectified by the diode 14 and stored in the capacitor 13. When the thyristor 16 is controlled to be conductive by the controller 30, the capacitor 13 discharges to flow a current to the primary coil 11. When the current is flowed to the primary coil 11, a high voltage is induced in the secondary coil 12 accordingly, and then a spark is generated by the spark plug 3 connected to the secondary coil 12.

Figure 2A:
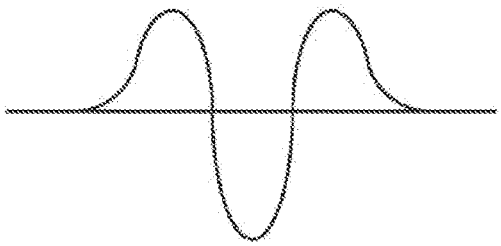
FIG. 2A illustrates the waveform of an induced voltage generated by a generator coil in a waveform shaping circuit of a power generator.
Figure 2B:
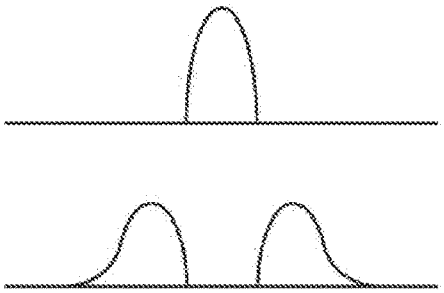
FIG. 2B illustrates shaped waveforms.
Figure 2C:
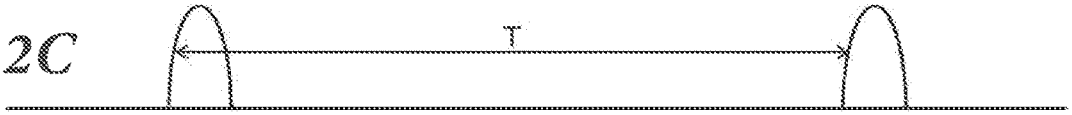
FIG. 2C illustrates a waveform period.

The power generator 20 includes the above-described generator coil 21, and also includes a waveform shaping circuit 22. The power generator 20 accumulates electricity in the capacitor 13 with the induced voltage of the generator coil 21. The waveform shaping circuit 22 shapes the waveform of the induced voltage of the generator coil 21. The waveform shaping circuit 22 shapes the waveform of the induced voltage generated by the generator coil 21 as illustrated in FIG. 2A into two waveforms as illustrated in FIG. 2B. The waveform shaped by the waveform shaping circuit 22 can be treated as a pulse signal having period T as illustrated in FIG. 2C, which becomes an input signal to the controller 30.

The controller 30 controls the ignition timing of the ignition circuit 10, that is, the timing at which the thyristor 16 becomes conductive by the input signal from the waveform shaping circuit 22 which is generated by the induced voltage of the generator coil 21. For this timing control, the controller 30 includes a speed computation part 31 and an ignition timing calculation part 32.

The speed computation part 31 computes an engine rotational speed or frequency as operating information, based on the input signal from the waveform shaping circuit 2. The input signal can be treated as a pulse signal having the period T as described above, and therefore it is possible to obtain the engine rotational speed by calculating the reciprocal of the period T (1/T).

The ignition timing calculation part 32 calculates and outputs the ignition timing according to the engine rotational speed obtained by the speed computation part 31. The ignition timing is calculated for each rotation of the engine, and a signal to make the thyristor 16 conductive is outputted at a predetermined timing.

The sensor 2 of the ignition coil unit 1 detects load information and inputs the load information to the controller 30. The load information provides the knowledge of what load state of the engine with the ignition coil 1, or the working machine equipped with this engine during the operation, which is, for example, temperature information, vibration information, and sound information. The sensor 2 is a temperature sensor when used to detect the temperature information, is a vibration sensor when used to detect the vibration information, and is a sound sensor when used to detect the sound information. Hereinafter, an example where the temperature sensor is used as the sensor 2 and the temperature in the unit is detected as the load information will be described. However, this is by no means limiting as the embodiment.

The controller 30 includes a temperature measurement part 33 configured to measure the temperature from a detection signal of the sensor 2. The controller 30 also includes a memory 34 configured to store the engine rotational speed as the operating information outputted from the speed computation part 31 and the temperature in the unit as the load information outputted from the temperature measurement part 33 in chronological order by using a time stamp function of the controller 30. Moreover, the controller 30 includes a timer 35 configured to allow the memory 34 to store working time information corresponding to the engine rotational speed as the operating information and the temperature in the unit as the load information described above.

The controller 30 includes a matrix determination part 36 configured to allow the memory 34 to store the working time information corresponding to the engine rotational speed (hereinafter "speed") as the operating information and the temperature in the unit (hereinafter "temperature") as the load information, as matrix data composed of the operating information, the load information, and the time data.

Figure 3:
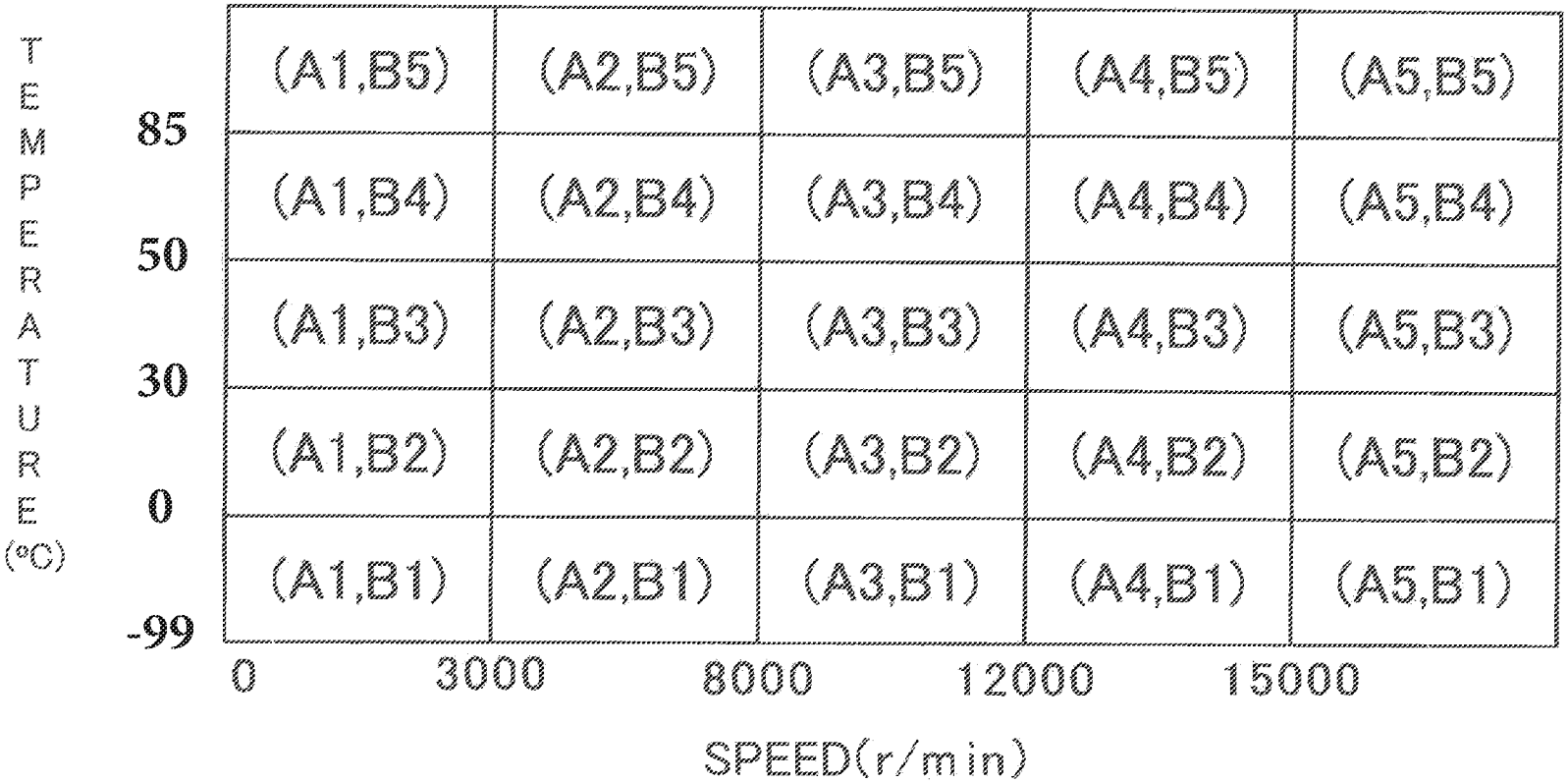
FIG. 3 illustrates an example of matrix data stored in a memory.

FIG. 3 illustrates a constitutional example of the matrix data produced by the matrix determination part 36. Here, two axes of the sections of the matrix constituting the matrix data indicate speed (r/min) and temperature (° C.), respectively.

The matrix determination part 36 determines which of 25 sections of the matrix (An, Bn) {(A1, B1), (A1, B2), . . . , (A1, B5), (A2, B1), . . . , (A2, B5), . . . , (A5, B5)} corresponds to the speed and the temperature of the engine during the operation. The timer 35 measures the working time of the corresponding section to obtain a cumulation of the working time of each of the sections. Then, the controller 30 causes the memory 34 to store the obtained cumulative time.

In addition, the controller 30 also causes the memory 34 to store operating status data. This operating status data includes at least one of the total operating time of the working machine, the maximum value of the operating information such as the engine rotational speed, the maximum value of the load information such as the temperature in the unit, the number of times of trying recoil to start the engine, the number of times of starting (number of start) of the engine, and the number of times the engine rotational speed exceeds a set value. The controller 30 updates the operating status data as needed, and causes the memory 34 to store the data.

The operation of the controller 30 described above will be explained in detail with reference to the flowchart of FIG. 4. First, when the waveform of the input signal (pulse signal) generated by a waveform shaping part 22 of the power generator 20 is inputted (step S01), the controller 30 causes the speed computation part 31 to compute the engine rotational speed with the period T of the input signal (the time difference from the previous input) (step S02), and determines whether the computed speed exceeds a set value (step S02A). When determining that the computed speed exceeds the set value (step S02A; YES), the controller 30 counts up the number of times the computed speed exceeds the set value (step S02B).

Then, the controller 30 determines whether to update the maximum speed by comparison between the presently obtained speed and the maximum speed previously obtained (step S03). When determining to update the maximum speed (step S03; YES), the controller 30 causes the memory 34 to store the presently obtained speed as the maximum speed (step S04). In the step S03 of the comparative determination, when the waveform is inputted the first time, the presently obtained speed is stored as is in the memory 34 as the maximum speed.

On the other hand, when determining not to update the maximum speed (step S03; NO) or after the maximum speed is saved in the memory 34, the controller 30 causes the ignition timing calculation part 32 to calculate the ignition timing with the presently obtained speed (step S05).

In addition, upon receiving the input signal described above, the controller 30 causes the temperature measurement part 33 to obtain a detection signal from the sensor 2 to measure the temperature (step S06). Then, the controller 30 determines whether to update the maximum temperature by comparison between the presently obtained temperature and the maximum temperature previously obtained (step S07). When determining to update the maximum temperature (step S07; YES), the controller 30 causes the memory 34 to store the presently obtained temperature as the maximum temperature (step S09).

On the other hand, when determining not to update the maximum temperature (step S07; NO), the controller 30 determines whether to update the minimum temperature by comparison between the presently obtained temperature and the minimum temperature previously obtained (step S08). When determining to update the minimum temperature (step S08; YES), the controller 30 causes the memory 34 to store the presently obtained temperature as the minimum temperature (step S10). In the step S07 and the step S08 of the comparative determination, when the waveform is inputted the first time, the presently obtained temperature is stored as is in the memory 34 as the maximum temperature and the minimum temperature.

After determining to update the maximum temperature and the minimum temperature, the controller 30 causes the matrix determination part 36 to perform matrix determination, based on the presently obtained speed and temperature (step S11).

In the matrix determination, the controller 30 determines which of the preset matrix sections (An, Bn) corresponds to the presently obtained speed and temperature; obtains the timer value from the timer 35 having counted the period T of the input signal (step S12); and cumulates the obtained timer value for each of the corresponding matrix sections (step S13). After that, the controller 30 outputs an output signal to the ignition circuit 10 at the ignition timing obtained in the step S05 to make the thyristor 16 of the ignition circuit 10 conductive, and performs ignition for each of the input signals (step S14).

Figure 4:
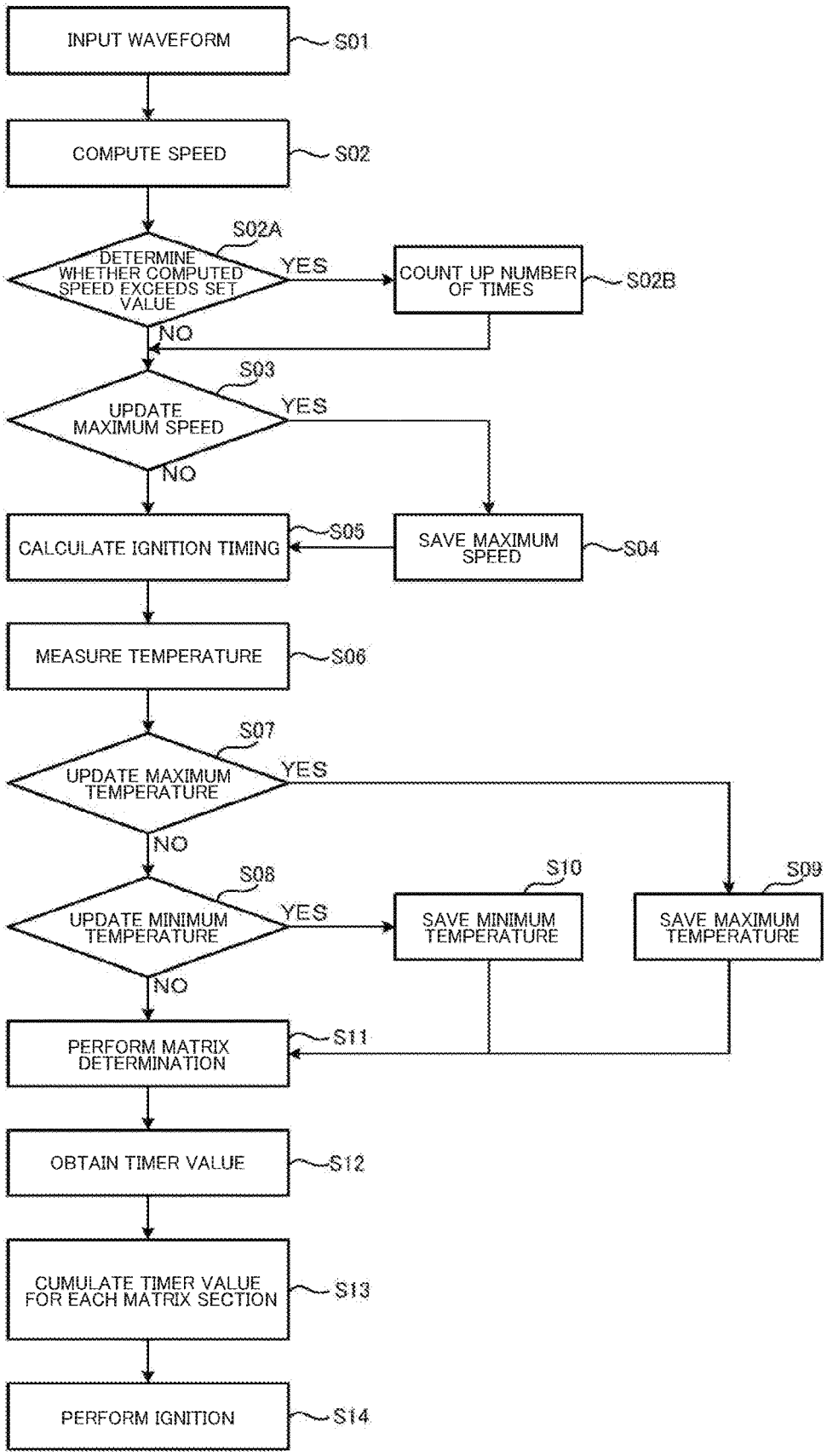
FIG. 4 is a flowchart illustrating an example of the operation of a controller.

The controller 30 discriminates the continuity of the input signals to obtain the number of times of trying recoil and the number of times of starting the operating status data, and saves the data in the memory 34 as needed (not illustrated in the flowchart of FIG. 4). Here, the controller 30 determines the starting when the engine continues to be rotated a set number of times at an engine rotational speed equal to or higher than a set value, and counts up the number of times of the starting, and determines the recoil when the input signals continue to be inputted after the controller 30 is powered on before the engine is started.

Moreover, the controller 30 sums the cumulative time for each of the matrix sections stored as the matrix data to obtain the total operating time as the operating status data.

The controller 30 can cause the memory 34 to save log data of the speed and the temperature obtained for each of the input signals by adding a step to the flowchart of FIG. 4. In this case, for example, the controller 30 causes the memory 34 to continuously save the log data every several seconds for several minutes, and after a set period of time has elapsed, overwrites the old data to save new log data. By this means, the controller 30 can cause the memory 34 to save significant log data such as the log data just before the engine stop with a limited memory capacity.

According to this ignition coil unit 1, it is possible to precisely determine the time for maintenance or replacement and diagnose failure by an appropriate evaluation index, by referring to the matrix data and the operating status data stored in the memory 34 which is built in the ignition coil unit 1. In addition, it is possible to understand the operation characteristic of the user of the individual engine or working machine, and the status of use of the working machine by analyzing the data stored in the memory 34 built in the ignition coil unit 1 of the individual engine, and therefore to provide service to each user with the personalized menu for the user. Moreover, the memory function of the ignition coil unit 1 essential to the engine is enriched, and therefore it is possible to solve the problems with precise maintenance and so forth at lower cost.

Hereinafter, an example of practical use of this ignition coil unit 1 will be specifically described. For example, at the time for maintenance, the user of the working machine brings the working machine to a dealer or store. Then, the ignition coil unit 1 is removed from the engine, and the memory 34 of the ignition coil unit 1 is connected to a diagnostic system. The diagnostic system includes, for example, a display device configured to display the matrix data and the operating status data stored in the memory 34.

In this case, the memory 34 has already stored user information such as user ID, and therefore it is possible to refer to or analyze the matrix data and the operating status data retrieved from the memory 34 in association with the user information. By employing this diagnostic system, the dealer can provide the individual user with service corresponding to the characteristic of the user.

Understanding the status of use from the matrix data can be used as a material for determining how the user is using the engine. When the matrix data of the engine rotational speed and the temperature indicates that the engine is operated within a predetermined range of rotational speeds and a predetermined range of temperatures, it can be information to understand that the user ideally uses the engine, and, on the other hand, when the matrix data of the engine rotational speed and the temperature indicates that the engine is operated out of the predetermined range of rotational speeds and the predetermined range of temperatures, it can be information to understand that the user does not ideally use the engine.

In addition, in the case of understanding the status of use of the engine by the operating status data, the maximum rotational speed, the number of times the rotational speed exceeds the set value, and the maximum temperature and the minimum temperature in use can be information for the dealer to determine whether the user ideally uses the engine. In particular, in the case of analyzing the cause of a failure, when the number of times of rotation exceeds a value equal to or higher than the set value, it is possible to analyze that the failure is caused by a high rotational speed. In addition, it is possible to analyze that the failure is caused by the temperature, by inspecting from the maximum or minimum temperature in use whether the engine is used under a condition in conformity to the requirement of the service temperature of electronic parts in the ignition coil unit 1. Moreover, in particular, when the engine fails many times, the matrix data and the operating status data presented from the dealer to the user, can be used as information to teach the user about the operation getting close to the ideal use.

In the case of understanding the status of use of the engine by another operating status data, it is possible to evaluate the starting capability of the working machine by the number of times of trying recoil and the number of times of starting. The starting capability of the working machine can be information for the dealer to know the state of the working machine, for example, the deterioration of the working machine. In addition, the starting capability of the working machine has a cause-and-effect relationship with the operating environment, and therefore the dealer can understand the effect of the operating environment on the starting capability of the working machine, by analyzing the correlation of the number of times of trying recoil or the number of times of starting with the matrix data or the maximum temperature and the minimum temperature.

As described above, by employing the ignition coil unit 1 according to the embodiment of the invention, it is possible to understand the operating characteristic (operating status) of the user, and the state and the operating environment of the working machine, by the matrix data and the operating status data (total operating time, the maximum temperature in use, the maximum rotation frequency, the number of times of trying recoil, and the number of times of starting). Therefore, the dealer can propose the next time for maintenance to the individual users, based on the operating characteristic of each of the users.

Moreover, the dealer can determine whether the user is a heavy user who frequently uses the working machine or a light user who infrequently uses the working machine, based on the operating status data such as the total operating time. Therefore, when introducing a new product or article to the user, the dealer can provide the product or article corresponding to the status of use of the user, and after that, provide maintenance corresponding to the status of use of the user.

As described above, the ignition coil unit 1 according to the embodiment of the invention allows understanding the status of use of the user, the cause of failure, and the state and the operating environment of the working machine, by the matrix data and the operating status data. Therefore, it is possible to provide precise evaluation for the maintenance of the engine and the working machine, and consequently to provide service to the individual users which corresponds to the operating characteristic of each of the users.

As described above, the embodiments of the present invention have been described in detail with reference to the drawings. However, the specific configuration is not limited to the embodiments, and the design can be changed without departing from the gist of the present invention. In addition, the above-described embodiments can be combined by utilizing each other's technology as long as there is no particular contradiction or problem in the purpose and configuration.

The invention claimed is:

1. An ignition coil unit comprising:

an ignition circuit including a primary coil and a secondary coil;

a power generator including a generator coil;

a controller configured to control an ignition timing of the ignition circuit by an input signal generated by an induced voltage of the generator coil; and a sensor configured to input load information, including a temperature of the ignition coil unit, to the controller, wherein the controller includes a memory configured to store working time information which corresponds to operating information based on the input information and the load information, as matrix data composed of the operating information, the load information and time data, wherein said operating information includes an accumulation of information on the temperature of the ignition coil unit and information on engine rotational speeds during operation of the engine over time, and wherein the memory stores user information.

2. The ignition coil unit according to claim 1, wherein the operating information is an engine rotational speed.

3. The ignition coil unit according to claim 1, wherein the sensor is a temperature sensor, and the load information is a temperature in the ignition coil unit.

4. The ignition coil unit according to claim 1, wherein:

the input signal is a pulse signal obtained by shaping a waveform of the induced voltage of the generator coil; and the operating information is obtained by computing a pulse period of the pulse signal.

5. The ignition coil unit according to claim 1, wherein the controller causes the memory to store operating status data.

6. The ignition coil unit according to claim 5, wherein:

the operating status data includes at least one of a total operating time, a maximum value of the operating information, a maximum value of the load information, a number of times of trying recoil to start an engine, a number of times of staring the engine, and a number of times an engine rotational speed exceeds a set value; and the controller updates the operating status data as needed and causes the memory to store updated operating status data.

* * * * *